United States Patent [19]

Kajita et al.

[11] Patent Number: 4,895,367

[45] Date of Patent: Jan. 23, 1990

[54] GOLF CLUB SET

[75] Inventors: Ryota Kajita, Chiba; Hidekimi Inoue, Saitama, both of Japan

[73] Assignee: Bridgestone Corporation, Tokyo, Japan

[21] Appl. No.: 203,226

[22] Filed: Jun. 6, 1988

[30] Foreign Application Priority Data

Jun. 5, 1987 [JP] Japan ..... 62-140944

[51] Int. Cl.[4] ..... A63B 53/04

[52] U.S. Cl. ..... 273/77 A; 273/80 C

[58] Field of Search ..... 273/77 A, 167 H, 169, 273/170, 171, 172, 80 A, 80 C, 80.2

[56] References Cited

U.S. PATENT DOCUMENTS

| | | | |
|---|---|---|---|
| 2,784,969 | 3/1957 | Brandon | 273/77 A |
| 3,539,184 | 11/1970 | Koorland | 273/77 A |
| 4,762,322 | 8/1988 | Molitor et al. | 273/77 A |

*Primary Examiner*—George J. Marlo

*Attorney, Agent, or Firm*—Jordan and Hamburg

[57] ABSTRACT

A golf club set comprises first and second groups of golf clubs, the first group of clubs being of the wood type and the second group of clubs being of the ion type, each of the clubs in the set comprising a shaft connected to a head at one end of said shaft, each, of the shafts having an axis X passing through the center of the shaft, each of the heads having a sole, a hitting face for hitting a golf ball and a hitting spot which is the point of contact between the striking face and the ball when the sole of the club is squarely set on the playing surface, the hitting face being inclined to define a loft angle, each of the clubs having a distance y which is the distance between the axis X and a vertical axis X′ passing through the hitting spot, the axes X and X′ lying in a plane perpendicular to the hitting face, the wood type clubs and the iron type clubs each being designated by a number which is a single digit, the greater the loft angle of the club the higher the digit by which the club is designated, and the difference in the distance y between the highest number club in the set of the wood type and the lowest number club in the set of the ion type being less than 10 mm.

3 Claims, 7 Drawing Sheets

GOLF CLUB SET

BACKGROUND OF THE INVENTION

1. Field of the Invention

The present invention relates to a golf club set consisting of a plurality of golf clubs.

2. Description of the Prior Art

In case of the wood clubs among a conventional golf club set consisting of wood clubs or woods and iron ones or irons, an axis X passing through the center of the shaft 1 thereof and a line X' passing through the hitting spot H and parallel to the axis X lie in a plane squarely facing the golfer as shown in FIG. 1. Assume here that the distance between X and X' in the above-mentioned plane is y (taking as positive the relation between the axis X and the hitting spot H when the axis X is in front of the hitting spot H and the relation as negative when the axis X is behind the hitting spot H. (The "hitting spot H" is the point of contact between the hitting face of the club and a golf ball when the sole of the club is squarely set on the playing surface.) The hitting spot H on the club face lies in front of the axis in the direction of the ball's flight and the distance y between X and X' is within a range of about −5 to −20 mm for the woods, and is within a range of about −1 to 5 mm for the irons, as indicated in FIG. 2. For example, for a golf club set consisting of 12 clubs in total, i.e. wood Nos. 1, 3, 4, 5, iron Nos. 3~9, and pitching wedge, the values of y of the clubs are distributed as indicated by the graph in FIG. 3. For a conventional golf club set the difference in y between a large number wood club, e.g. W 5, and a small number iron club, e.g. I 3, exceeds 10 mm.

For a conventional golf club set there exists a difference in y exceeding 10 mm even between a high number club among the wood clubs, e.g. wood No. 5 (W 5) and a small number club among the iron clubs, e.g. iron No. 3 (I 3) and the golfer is disoriented, when he changes the club which he uses from the wood club to the iron one. Therefore, it is difficult to properly use them and he is susceptible to a missed shot.

For a conventional wood club, whose head is made of persimmon, the value of y is within a range from −10 to −20 mm, so that the ball hit by any average golfer with a wood is likely to result in a slice. This is due to the fact that since he swings trying to hit the ball B at a spot of the club head which lies on the shaft 1, namely, on or near the extension of the grip, the ball B is hit by the club head earlier than he thinks because the hitting spot H lies in front of the shaft 1. The ball is impacted by the club head before he has completely directed the club face toward the target. That is, the ball is hit with the club face open. At this time, a slicing rotation is imported to the ball, even if the head 2 is swung along the line of ball's flight Z. Also during his swing, his wrist rotates (causing the rotation of the head around the shaft 1 and rolling of the head) and the velocity v of the hitting spot H resulting from the wrist rotation acts to impart a slicing rotation to the ball B as shown in FIG. 4. This velocity v of the hitting spot H is determined from the equation $v=r\omega$ (where r is a distance from the center of the rolling to the hitting spot H and $\omega$ is an angular velocity of rotation). If he tries to hit ball B with the club face somewhat closed on purpose as shown in FIG. 5 in order to correct the slice, the ball thus hit will result in a hook. However, this hitting technique cannot easily be attained by the average golfer. The professional and skillful golfers have a full understanding of the differences between the woods and irons and use the clubs effectively. The majority of the average or beginner golfers use both the woods and irons in a same manner. The ball hit by the average golfer with a wood is apt to result in a slice. Further, the average golfer hardly handles long irons (I 3~I 4) and for a distance with respect to which the ball hit by the wood club No. 3 or 4 flies too far, almost all the golfers using I 3 or I 4 fail to make the ball reach the pin. For the average golfer there is a gap between the wood clubs Nos. 3 and 4 and the long irons, which is rarely overcome.

SUMMARY OF THE INVENTION

Therefore, the present invention has an object to provide a golf club set, whose long irons and large number wood clubs, which are hardly handled by the average golfer, can be used with the same feeling, and which is useful for preventing an extreme slice or hook ball from resulting.

In order to achieve the above object, according to the present invention, the difference in y between a large number wood club and a small number iron club is set to be smaller than 10 mm. According to the present invention, since the difference in y between the large number wood club and the small number iron club is set to be smaller than 10 mm, the gap between the large number wood club and the long iron; which was scarcely overcome by the average golfers, can be filled. In particular, in the case where the value of y of the wood club was set to be positive, there was a problem concerning the strength, when the head was made of persimmon, but this problem has been completely resolved by the development of new materials such as metal, FRP, etc., even if the value of y is set to be positive.

DETAILED DESCRIPTION OF A PREFERRED EMBODIMENT

Figure 1:
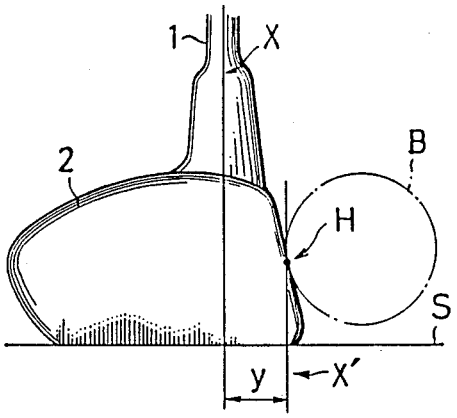
FIG. 1 (PRIOR ART)
FIG. 1 is a front view of a conventional wood.
Figure 2:
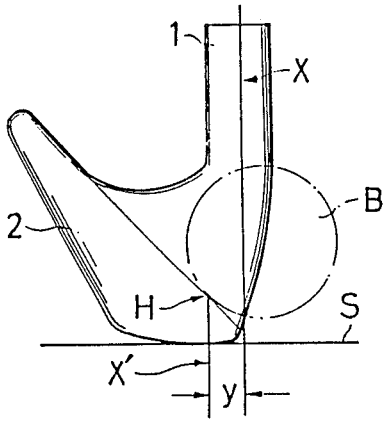
FIG. 2 (PRIOR ART)
FIG. 2 is a front view of a conventional iron.
Figure 3:
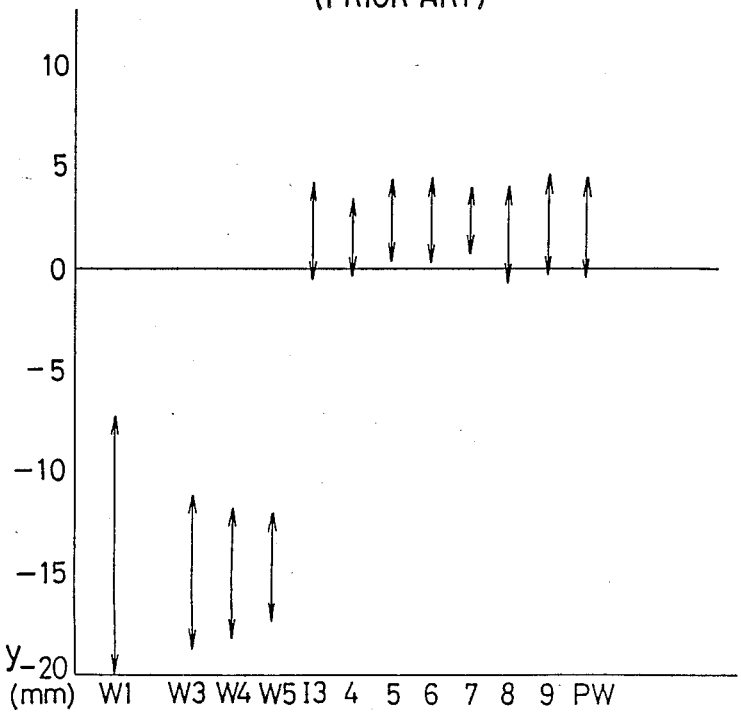
FIG. 3 (PRIOR ART)
FIG. 3 is a graph showing the distribution of the value of y of the conventional clubs.
Figure 4:
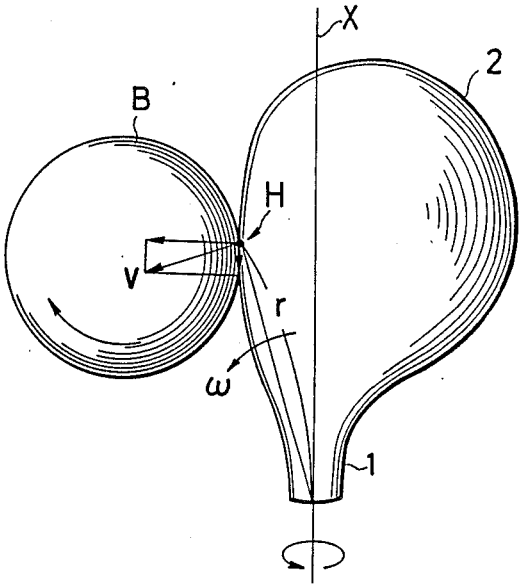
FIG. 4 (PRIOR ART)
FIG. 4 is a scheme for explaining how the slicing rotation is imparted to the ball by the conventional wood club.
Figure 5:
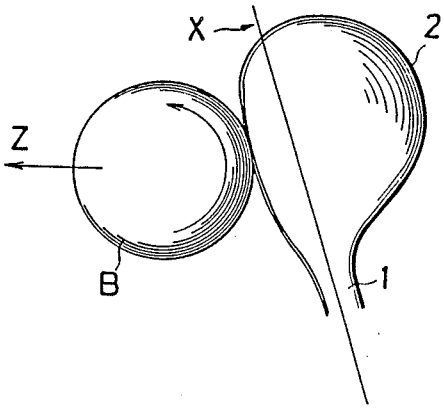
FIG. 5 (PRIOR ART)
FIG. 5 is a scheme for explaining how the hooking rotation is imparted to the ball by the conventional iron club.

Hereinbelow a preferred embodiment of the present invention will be explained, referring to the drawings.

Figure 11:
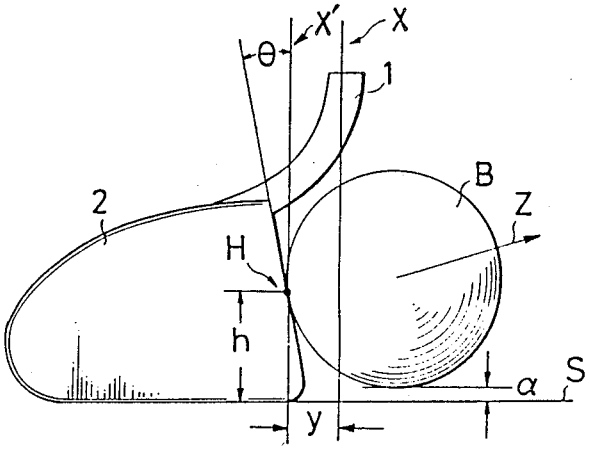
FIG. 11 is a front view showing an example of the wood clubs in a golf club set according to the present invention.

In the case where a conventional iron club set is completed by adding wood clubs thereto, i.e. in the case where setting of the value y for the clubs is effected so that the feeling of irons is imparted to all the clubs the distance between the axis X passing through the shaft center of the club shaft 1 and a hitting spot H on a plane squarely facing the golfer on a large number club among the clubs heretofore called wood clubs is represented by y, as indicated in FIG. 11, this value of y is set to be positive, i.e. the hitting spot H is set behind the axis X. The hitting spot H is a geometrical hitting point. Under the assumption that the height from the point of contact with the horizontal plane S of the sole of the head 2 is h, this height is defined by the following equation;

$$h = A(1 - \sin\theta) + \alpha$$

where $\theta$: Angle of loft

A: Radius of the ball B $\alpha$: Height of the ball bottom from the ground

Figure 6A:
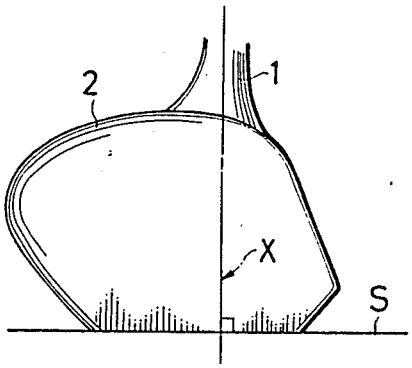
FIGS. 6 (*a*) and (*b*) through FIGS. 10 (*a*) and (*b*) are front views and right side elevations, respectively, showing the state in which club heads of various forms are set for measurement of the value of y.
Figure 6B:
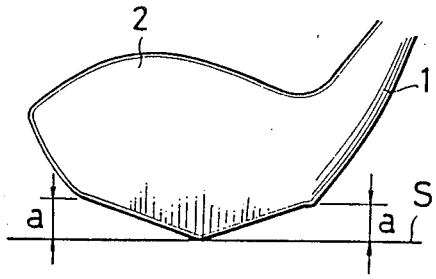
Figure 7A:
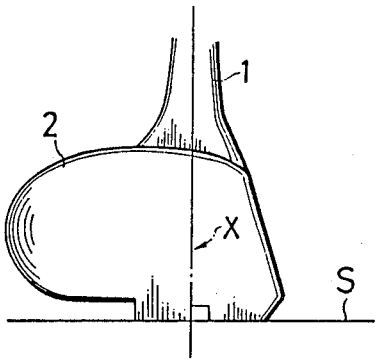
Figure 7B:
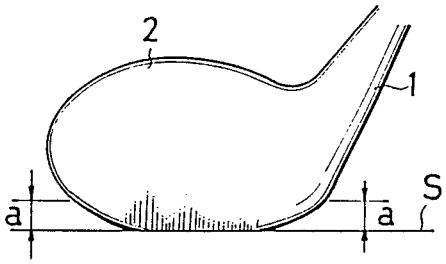
Figure 8A:
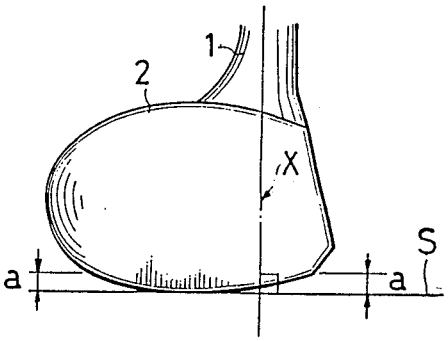
Figure 8B:
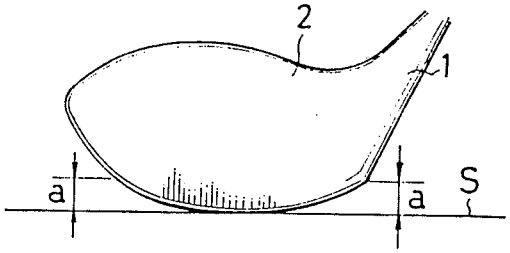
Figure 9A:
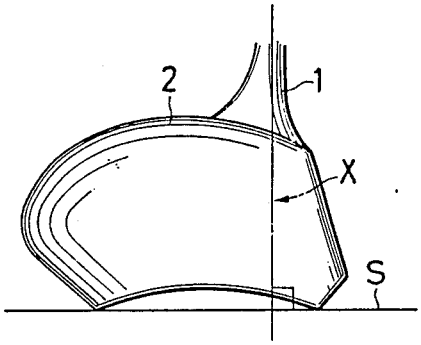
Figure 9B:
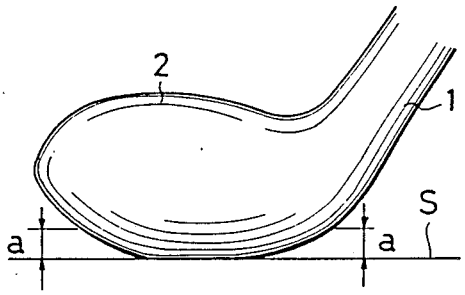
Figure 10A:
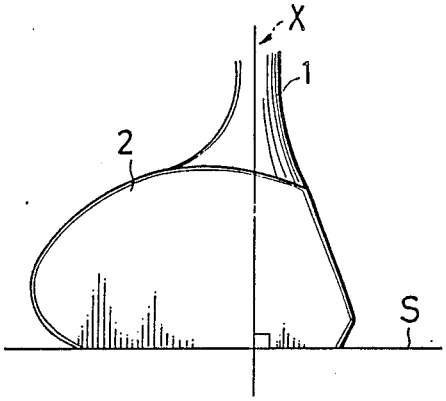
Figure 10B:
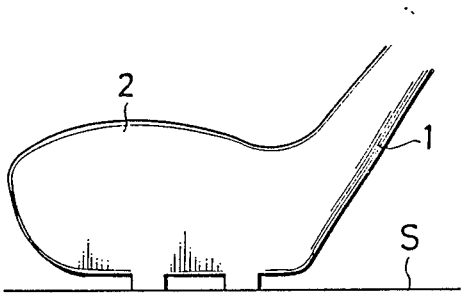
Figure 12:
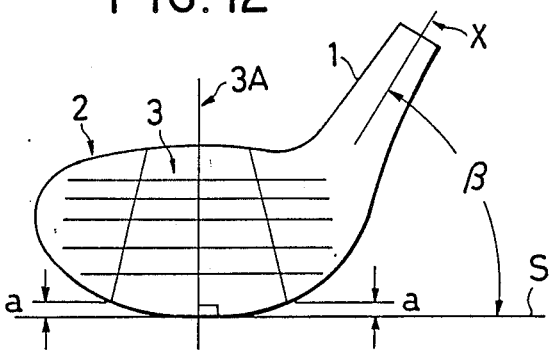
FIGS. 12 through 15 are schemes showing how the hitting spot H is located.
Figure 13:
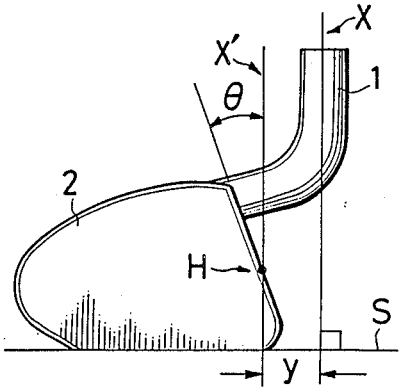
Figure 14:
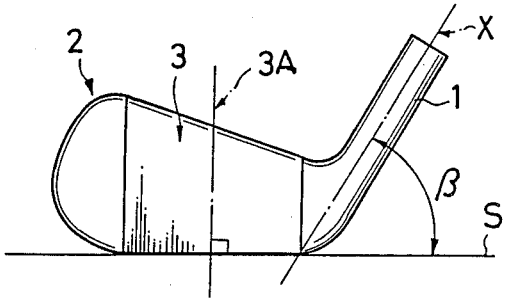
Figure 15:
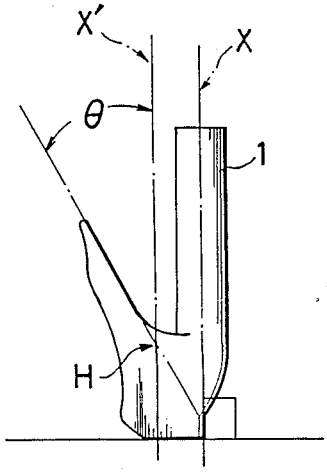
Figure 16:
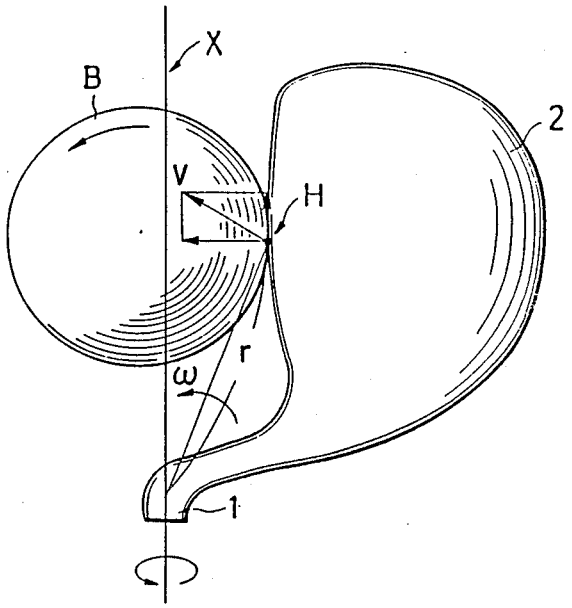
FIG. 16 is a plan view for explaining how the wood club indicated in FIG. 11 acts on the ball.

Here, the ball-bottom height $\alpha$ is selected to be 2.5 mm in consideration of the grass height, and a ball of 21.4 mm radius, namely, a large ball, is used. The arrow Z in FIG. 11 indicates the direction of flight of the ball B (line of flight). The distance y, hitting spot H, angle of loft $\theta$ and angle of lie $\beta$ shown in FIGS. 11 and 13 are defined as follows. First, a plane is squarely viewed in which the axis X passing through the axis of the shaft 1 with the club head viewed from the direction of ball's flight as shown in FIG. 12 lies and which is perpendicular to the horizontal plane S (ground surface). Next, the sole of the club head 2 is placed on the horizontal plane S, and an imaginary line 3A is assumed which passes through the spot of contact with the plane S and perpendicular to the plane S. The club head is finally set by moving the spot of contact between the sole contour and horizontal plane S so that the sole contour is nearly horizontally symmetrical in the maximum range with respect to the imaginary line 3A. In this state, the angle of lie $\beta$ (see FIG. 12) and angle of loft $\theta$ (see FIG. 13) are determined, the hitting spot H is determined based on the height h already defined, and the distance y shown in FIG. 13 is measured. For other clubs, whose heads 2 have various shapes, as indicated in FIGS. 6 (*a*) and (*b*) through FIGS. 10 (*a*) and (*b*), the hitting spot H is obtained after having set the club. For a so-called wood club constructed as indicated in FIG. 16, the velocity v of the hitting spot H resulting from the wrist rotation acts to impart a hooking rotation to the ball B. When the golfer swings a club corresponding to such a wood club, trying a hit the ball B at a spot of the club head which lies on or near the extension of the grip, it is possible to prevent a slicing ball from resulting.

Figure 17:
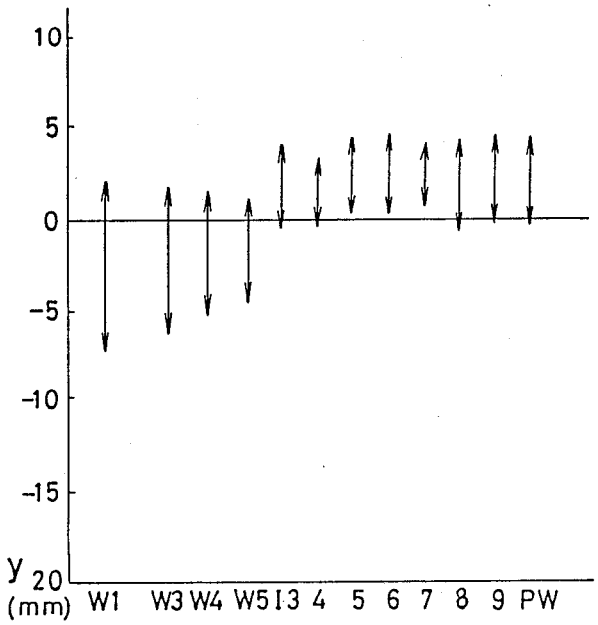
FIG. 17 is a graph showing an example of setting the value y for the clubs of a set.

A golf club set, for which y of the large number wood club is set within a range of about $-8 \sim 3$ mm and y of the small number iron club is set within a range of about $-1 \sim 5$ mm, can be represented, as shown in FIG. 17. Because all the clubs of such a golf club set, have a feeling close to that of irons, the wood and iron clubs can be used properly when the golfer changes the club which he uses from the former to the latter and, therefore, a missed shot occurs only rarely.

Figure 18:
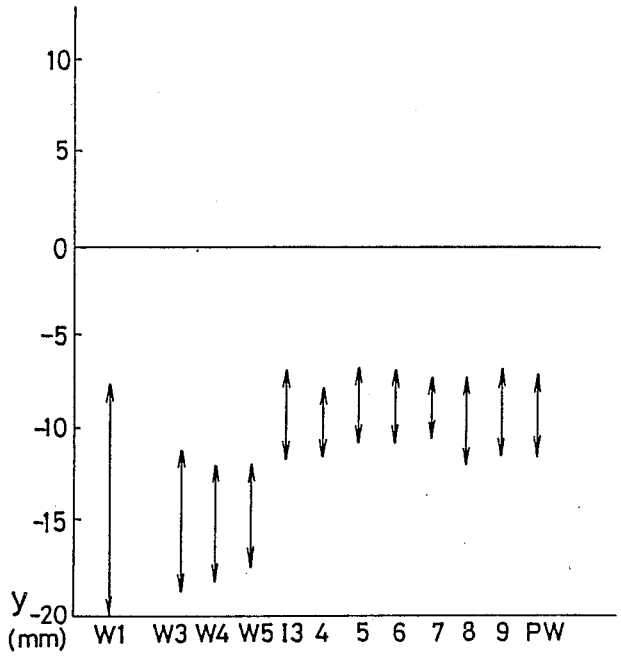
FIG. 18 is a graph showing another example of setting the value y for the clubs of a set.

As another combination, as indicated in FIG. 18, it is possible also to set y of the iron clubs so as to be in accordance with the feeling of the conventional wood clubs. In this way all the clubs can be used with the feeling of woods.

Figure 19:
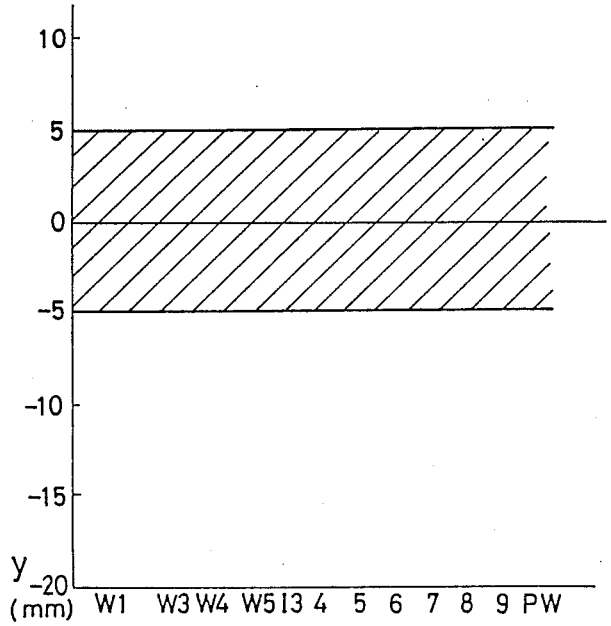
FIG. 19 is a graph showing still another example of setting the value y for the clubs of a set.

Furthermore, in the case where the golfer tries to hit the ball at a point on the extension of the grip, y of all the clubs may be set within a range of $-5 \sim 5$ mm, as indicated in FIG. 19. A golfer who is good at shots with the iron clubs may use clubs set as indicated in FIG. 17, and a golfer who is good at shots with the wood clubs may use clubs set as indicated in FIG. 18. The average golfers, who are worried about occurrence of slicing balls due to use of the wood clubs, may set their clubs within the hatched region indicated in FIG. 19. Although, in the above, the difference in y between the large number wood club and the small number iron club is determined so as to be smaller than 10 mm, more preferably it is smaller than 5 mm. By setting it below 5 mm it is possible to hit the ball with the same feeling with either kind of clubs. In addition, although, in the figures, a set consists of 4 woods, 7 irons and 1 pitching wedge, it is a matter of course that these combinations can be varied, depending on the preference of each golfer, and principles of the present invention may be readily applied thereto.

According to the present invention, since the difference in y between different clubs is smaller than 10 mm, whichever club is used, e.g. club No. 5 (W5), which is a large number wood club, or club No. 3 (I 3), which is a small number iron club, it is possible for the golfers to hit the ball with the same feeling by using either a wood or a long iron, and thus the gap between e.g. a wood No. 3 or 4 and a long iron is filled. In particular, when the golfer tries to hit the ball at a point on the extension of the grip for all the clubs, an extreme hooking or slicing ball hardly ever occurs owing to the fact that all the clubs are set so that $y = -5 \sim 5$ mm and it becomes unnecessary for the golfer to develop a high level of expertise to use the clubs effectively, as in the past.

What is claimed is:

1. A golf club set comprising first and second groups of golf clubs, the first group of clubs being of the wood type and the second group of clubs being of the iron type, each of the clubs in the set comprising a shaft connected to a head at one end of said shaft, each of the shafts having an axis X passing through the center of the shaft, each of the heads having a sole, a hitting face for hitting a golf ball and a hitting spot H which is the point of contact between the striking face and the ball when the sole of the club is squarely set on the playing surface, said hitting face being inclined to define a loft angle, each of the clubs having a distance y which is the distance between the axis X and a vertical axis X' passing through the hitting spot H, the axes X and X' lying in a plane perpendicular to the hitting face, the wood type clubs and the iron type clubs each being designated by a number which is a single digit, the greater the loft angle of the club the higher the digit by which the club is designated, and the difference in the distance y between the highest number club in the set of the wood type and the lowest number club in the set of the iron type being less than 10 mm.

2. A golf club set according to claim 1, in which the difference in the distance y between the highest number club in the set of the wood type and the lowest number club in the set of the iron type is less than 5 mm.

3. A golf club set according to claim 1, in which the distance y for each of the clubs is within the range of approximately $-5$ to 5 mm.

* * * * *